US006073794A

United States Patent [19]

Bidot

[11] Patent Number: 6,073,794

[45] Date of Patent: Jun. 13, 2000

[54] ORGANIZER

[76] Inventor: Eduardo Bidot, 89 Azalea Rd., Levittown, N.Y. 11756

[21] Appl. No.: 09/006,017

[22] Filed: Jan. 12, 1998

[51] Int. Cl.[7] ..... B65D 6/16; B65D 25/06

[52] U.S. Cl. ..... 220/529; 220/8; 220/543; 220/551; 312/348.3

[58] Field of Search ..... 220/8, 6, 510, 220/528, 529, 530, 543, 551, 552, 553, 23.88, 23.89; 312/111, 140, 140.3, 205, 344, 348.3; 403/205, 231, 109.1, 377; 217/69, 7

[56] References Cited

U.S. PATENT DOCUMENTS

| | | | |
|---|---|---|---|
| 256,809 | 9/1980 | Evenson . | |
| 354,516 | 1/1995 | Crist et al. . | |
| 356,338 | 3/1995 | Magnusson . | |
| 366,904 | 2/1996 | Stukenkemper . | |
| 1,711,030 | 4/1929 | Pifer | 220/543 X |
| 1,757,475 | 5/1930 | Pratt | 220/553 |
| 2,010,471 | 8/1935 | Ygberg | 217/7 |
| 2,161,624 | 6/1939 | Hoerr | 220/551 |
| 2,907,487 | 10/1959 | Harrington | 220/8 |
| 3,343,706 | 9/1967 | Berend . | |
| 3,746,181 | 7/1973 | Benoit . | |
| 3,837,477 | 9/1974 | Boudreau . | |
| 4,258,856 | 3/1981 | Marling | 220/552 |
| 4,577,773 | 3/1986 | Bitel | 220/533 |
| 4,595,246 | 6/1986 | Bross . | |
| 4,807,760 | 2/1989 | Sussman . | |
| 4,838,445 | 6/1989 | Lanius | 220/533 |
| 5,082,139 | 1/1992 | Quam | 220/530 |
| 5,148,942 | 9/1992 | Snook . | |
| 5,385,230 | 1/1995 | Nygard et al. | 220/8 X |
| 5,390,815 | 2/1995 | Spiegel . | |
| 5,553,710 | 9/1996 | Takama . | |
| 5,738,425 | 4/1998 | Rosenberg et al. | 220/8 X |
| 5,996,749 | 12/1999 | Hillsberg et al. | 206/320 X |

FOREIGN PATENT DOCUMENTS

| | | | |
|---|---|---|---|
| 0567653 | 3/1924 | France | 220/553 |
| 933311 | 4/1948 | France | 312/330 |
| 44911 | 11/1949 | France | 220/500 |

*Primary Examiner*—Allan N. Shoap
*Assistant Examiner*—Joe Merek
*Attorney, Agent, or Firm*—Dilworth & Barrese

[57] ABSTRACT

An organizer defining a plurality of compartments which are adjustable in size and shape by panels defining the compartments being adjustable in length.

10 Claims, 18 Drawing Sheets

ORGANIZER

BACKGROUND OF THE INVENTION

The present invention is directed to an organizer for compartmentalizing a storage area such as a drawer or briefcase. More particularly, the present invention is directed to an organizer which allows a user to conveniently arrange and adjust the various components thereof to fit storage areas of various dimensions.

Organizers such as compartmentalized trays have been known for some time. For example, U.S. Pat. No. 3,343,706 to Berend discloses a multiple size drawer divider construction comprising preformed units which can be arranged and fit together. U.S. Pat. No. 5,553,710 to Takama discloses a tray which can be compartmentalized by arranging dividers and partitions therein. Other examples of containers with interlocking spacers can be found, e.g., in U.S. Pat. Nos. 4,595,246 to Bross, 5,148,942 to Snook and 3,837,477 to Boudreau. Additionally, Showcase Technologies is presently marketing a briefcase for a notebook computer and comprising four outwardly disposed rails situated to form a rectangular perimeter when coupled together at four corners thereof, and a series of two inch or four inch long metallic partition bar structured to ride, at one end thereof, along the perimeter rails to thereby form a number of compartments within the perimeter (none of the partition bars extend entirely across the defined perimeter).

The interior dividers and spacers, along with the outer defining edges of the compartmentalized structures defined above, are all fixed in length. Accordingly, the ability to adjust size and shape of the interior compartments defined by these components is thereby limited. For example, the dividers of the above-identified systems would all have to be custom designed and pre-arranged to fit a required shape. Modification of the same could not be possible. Thus, the present invention recognizes a long-felt need to increase versatility and adjustability of such types of organizers so that objects of varying size and shapes placed therein can be securely retained depending upon need. Furthermore, there is a long-felt need to be able to conveniently adjust an organizer, during use, to accommodate a variety of objects during use.

Accordingly, it is an object of the present invention to provide an organizer which can be conveniently adjusted to fit into an outer container of varying size and shape and which can also be easily partitioned into a number of inner compartments of different sizes and shapes.

It is a more specific object of the present invention to facilitate adjustment of size and shape of an organizer together with adjustment of the various compartments therein.

Further objects of the present invention will be apparent from the description herein.

SUMMARY OF THE INVENTION

These and other objects are attained by the present invention which is directed to an organizer for forming a plurality of compartments and comprising panels formed to define an outer perimeter and two or more compartments within the perimeter, in addition to clip elements arranged to secure adjacent adjustable panels forming the perimeter together and also retain adjacent adjustable panels forming the plurality of compartments together. In particular, each panel can comprise at least two telescopically-arranged members, such that respective members can be extended out from or retracted into one another, with the panels each thereby having an adjustable length.

With the adjustable spacer system according to the present invention, a variety of storage areas, e.g. in a briefcase, desk drawer, etc., can be divided into compartments of various size and shape, with versatility of arrangement and further partition greatly improved over prior arrangements. In particular, because slidable adjustment of the individual telescoping panel members is provided in accordance with the present invention, both the overall size of the organizer and the dimensions of the individual compartments can be adjusted in situ to conform to the shape of the outer container and objects to be retained by the individual compartments. There is no longer a need to provide a multitude of individual components in order to assemble the organizer; a minimum number of component parts can be provided and then conveniently adjusted in situ, greatly conserving materials and simplifying assembling of the organizer. Once assembled, the organizer can be easily rearranged in situ, to form interior compartments of different size and dimensions, if need be; there is minimal need to remove and/or substitute component parts during this re-arrangement.

BRIEF DESCRIPTION OF THE DRAWINGS

The present invention will be described in further detail with reference to the accompanying drawings, in which.

DESCRIPTION OF THE PREFERRED EMBODIMENTS

Figure 1:
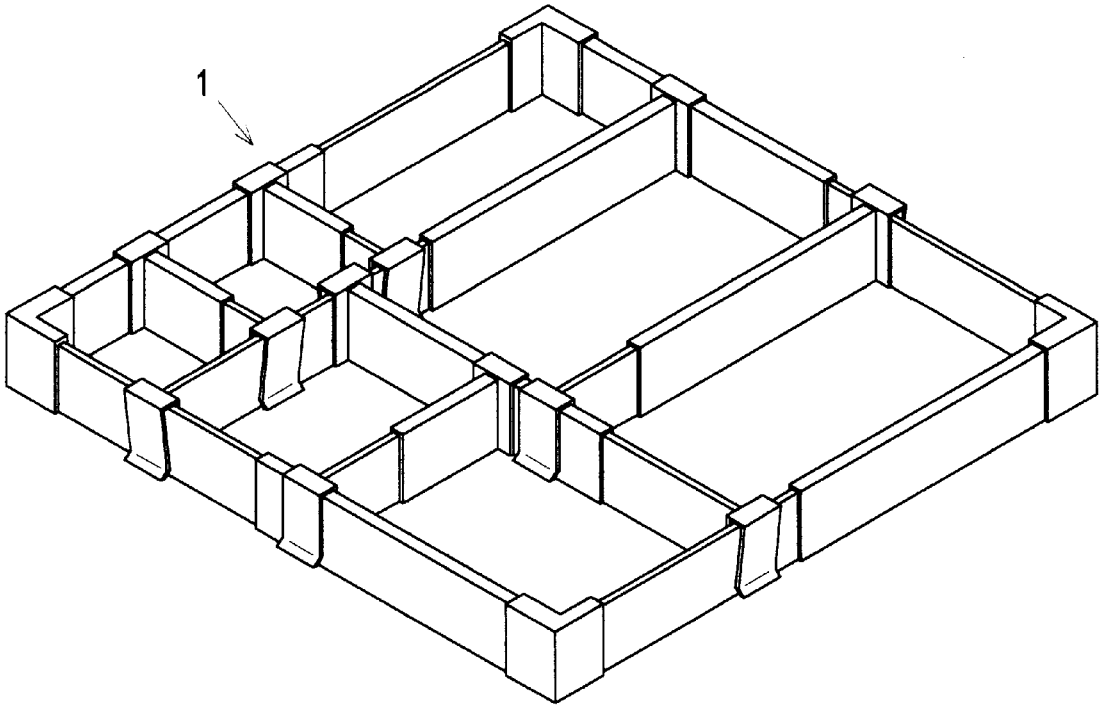
FIG. 1 is a perspective view of an organizer assembled in accordance with the present invention.

In the embodiments illustrated in the accompanying drawings, similar components will be denoted with similar reference numerals or with prime (') symbols thereof. Reference numerals have been omitted from some of the figures for purposes of clarity.

As illustrated in the figures, the organizer 1 of the present invention comprises; e.g., four outer perimeter panels 2 arranged to telescopically mate and define a substantially rectangular outline as illustrated, e.g., in FIGS. 1, 2C, 19 and 20. The outer perimeter panels 2 are secured together at ends thereof by clip elements 3 shaped at substantially right angles and which thereby define comers of the substantially rectangular perimeter. In this regard, a substantially rectangular perimeter has been illustrated in the embodiments shown in the accompanying figures. However, it is within the contemplation of the present invention to provide panels secured together with appropriate angular clip means to form a perimeter of different shape, e.g., a triangular perimeter comprising three perimeter panels and clip elements formed at acute angles.

More particularly, each panel 2 comprises two telescopic members 2*a* and 2*b* which are arranged to telescopically mate with one another. Each panel 2 comprises an outer hollow female telescopic member 2*a* and an male inner telescopic member 2*b*. The inner hollow dimensions of female member 2*a* and outer dimensions of male member 2*a* are substantially complementary. Therefore, the respective telescopic members 2*a* and 2*b* can be retracted together or extended away from each other to provide a panel 2 of adjustable length within the maximum extension of telescopic members 2*a* and 2*b*.

In the illustrated embodiments, four such outer perimeter panels 2, 2", 2'", 2"" have been denoted. While these respective panels have each been provided with two telescopic members 2*a* and 2*b*, it is within the contemplation of the present invention to feasibly provide more than two telescopic members within each panel, e.g., a series of several telescopic members 2*a*, 2*b*, 2*c*, 2*d*, etc. to enhance adjustability.

Figure 9A:
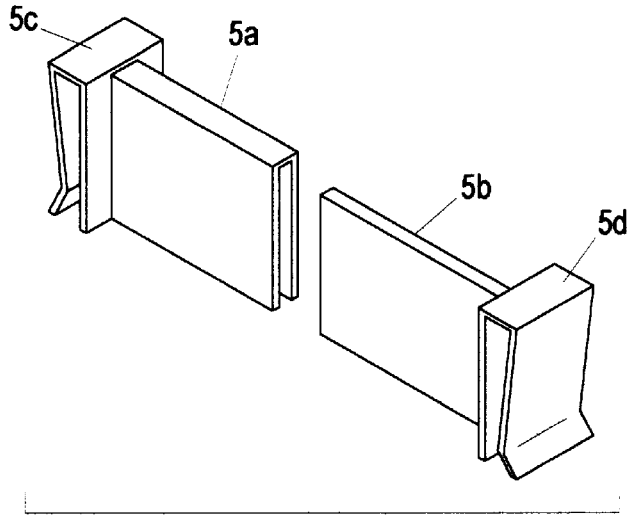
FIGS. 9A–9C are schematic perspective views illustrating assembling and adjustment of telescopic members forming a partition of the organizer.
Figure 9B:
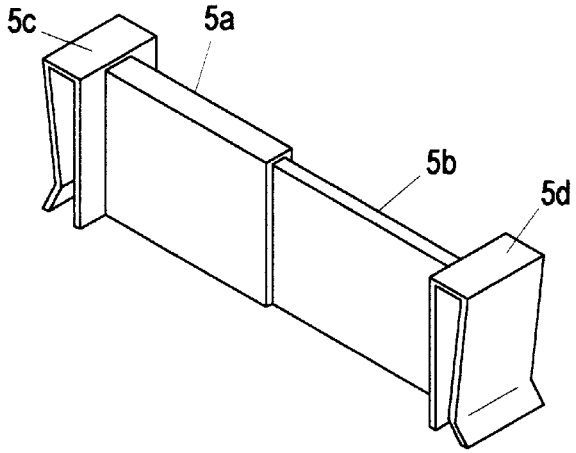
Figure 9C:
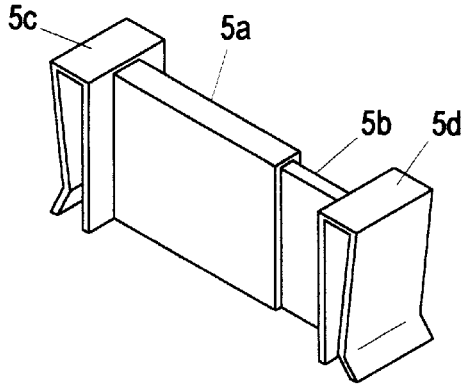

Furthermore, at least one adjustable panel 5 for dividing the organizer 1 into two or more compartments is also provided. As best seen in FIGS. 9A–9C, this interior panel 5 also comprises two telescopic members 5*a*, 5*b* structured to telescopically mate with one another as telescopic members 2*a*, 2*b* forming the perimeter panel 2, namely an outer hollow female telescopic member 5*a* and an inner male telescopic member 5*b*. While two such telescopic members 5*a* and 5*b* have been illustrated, it is also within the contemplation of the present invention to provide more than two telescopic members, e.g., several telescopic members within each divider panel 5, to enhance adjustability. Clip elements 5*c* and 5*d* are provided at the ends of the respective telescopic members for clipping onto respective perimeter panels 2 or onto other adjacent divider panels 5 as shown, e.g., in FIGS. 1, 2A–2C, 6A–6C, 19 and 20. In the embodiments illustrated in the present application, the clips 5*c* and 5*d* are integrally formed on the ends of the respective telescopic divider panel members.

Figure 7A:
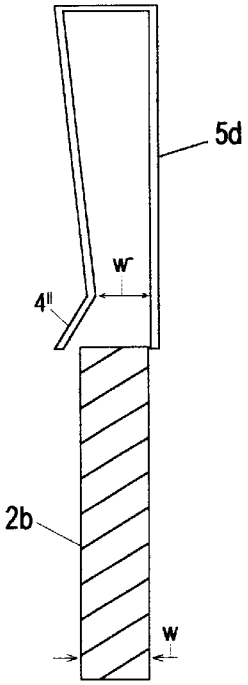
FIGS. 7A–7C are schematic views illustrating securing of a partition to an adjacent panel.
Figure 7B:
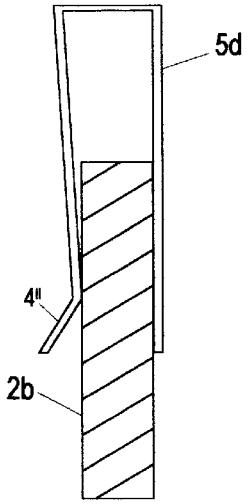
Figure 7C:
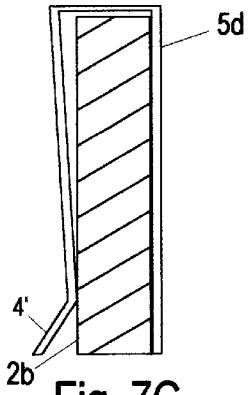
Figure 8A:
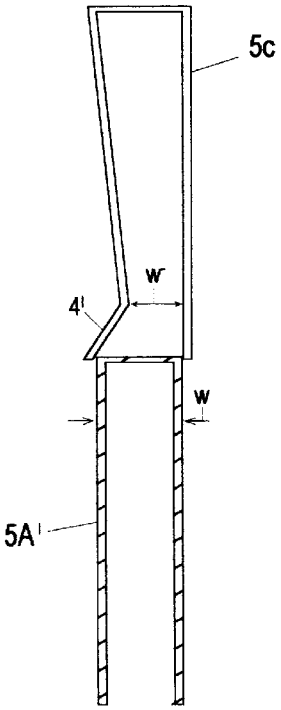
FIGS. 8A–8C represent schematic views, similar to FIGS. 7A–7C and illustrating securing of a partition to an adjacent panel of different structure.
Figure 8B:
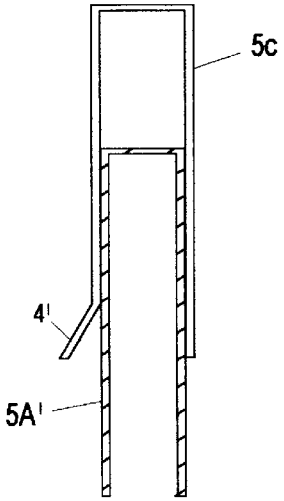
Figure 8C:
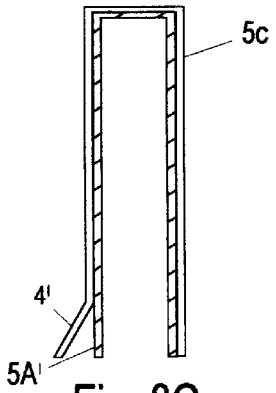

In this regard, FIGS. 6A–6C, 7A–7C and 8A–8C illustrate respective coupling of the divider panel 5 upon adjacent panels 5' and 2. As can be seen in FIGS. 7A and 8A, the clip elements 5*c* and 5*d* are each arranged to have an inwardly bent portion 4' or 4" defining a minimum interior width $\underline{w}$ that is smaller than a width $\underline{W}$ of a respective panel member 2*b* or 5*a'* to which panel 5 is being clipped. These clip elements 4*c* and 4*d*, which can be constructed of metallic material such as stainless steel or plastic such as polyethylenes or polypropylenes, are slightly resilient, i.e, can be spread outwardly upon insertion on the respective panels 5*a'* or 2*b* by being simply moved downwardly as illustrated in FIGS. 7B, 7C, 8B and 8C respectively. Because width $\underline{W}$ of the respective panels is only slightly greater than the narrow interior width $\underline{w}$ of respective clip elements 5*c* and 5*d*, these clip elements are not permanently deformed, i.e., will return to shape upon removal so that these clip elements 5*c* and 5*d* can be removed from the respective panels 5*a* and 2*b* and rearranged as desired. At the same time, panels 2, 5 and 5' will be maintained securely in position upon coupling as illustrated, e.g., in FIGS. 6C, 7C and 8C. Furthermore, clip elements 5*c* and 5*d* can be slid along the respective panels in situ, so that position of the divider panels 5 can be adjusted with shape and dimension of the thus-defined compartment also being adjusted.

It should be noted that the principle of clipping divider panels possessing clip elements integrally at ends thereof, can be applied to any other panel elements forming the inventive organizer, with arranging as desired. In this regard, FIGS. 1, 2C, 19 and 20 illustrate one possible arrangement which can be feasibly rearranged as desired.

The clip elements are simply removed from the respective panels, e.g., for rearrangement, by simply being moved in the opposite direction to that shown in FIGS. 7A–C and 8A–C.

Figure 2A:
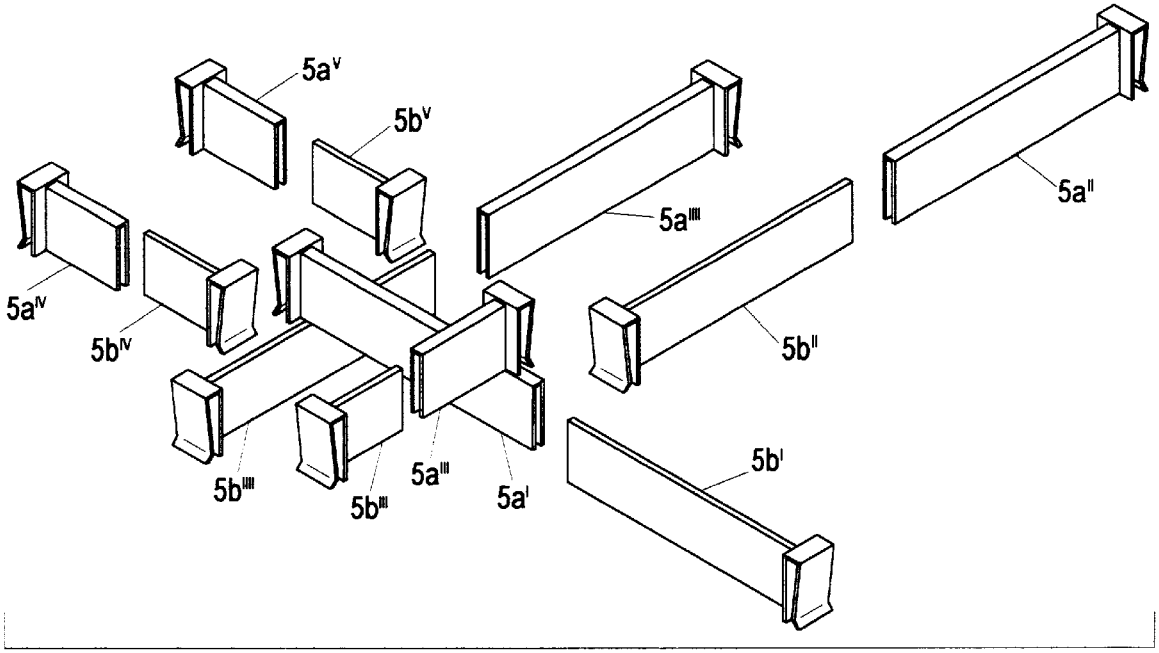
FIGS. 2A–2C are schematic perspective views illustrating assembling of the organizer shown in FIG. 1.
Figure 2B:
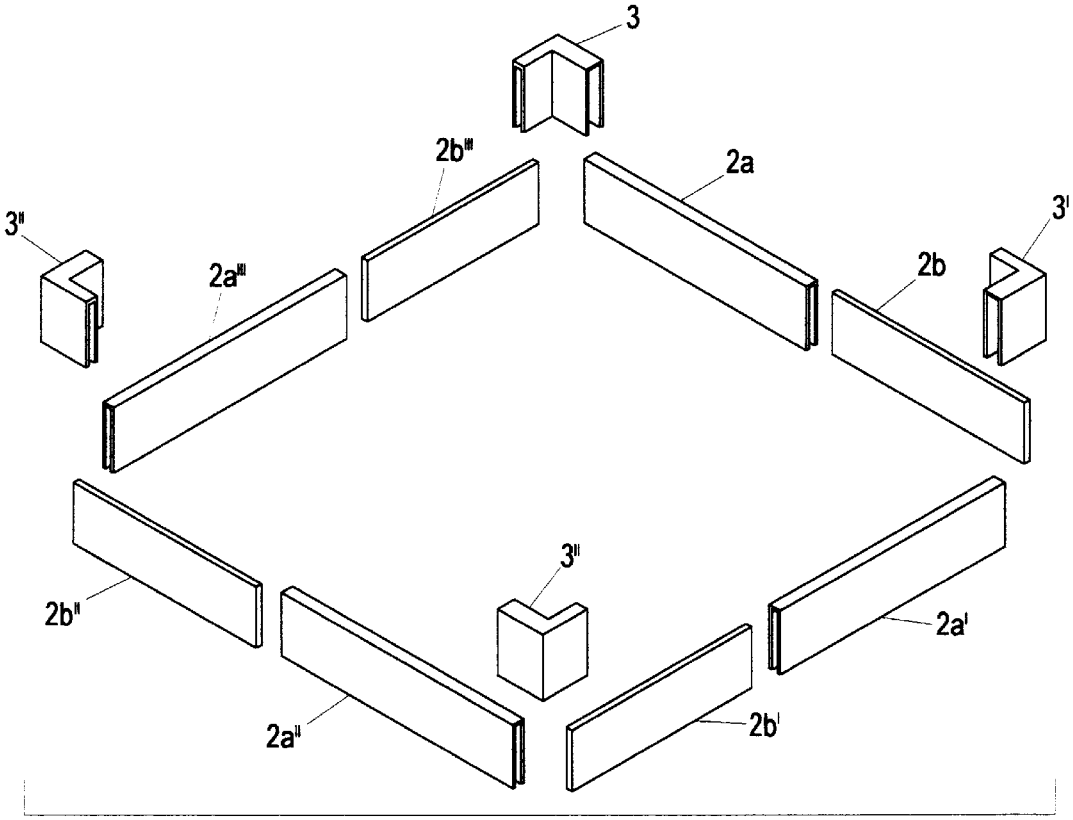
Figure 2C:
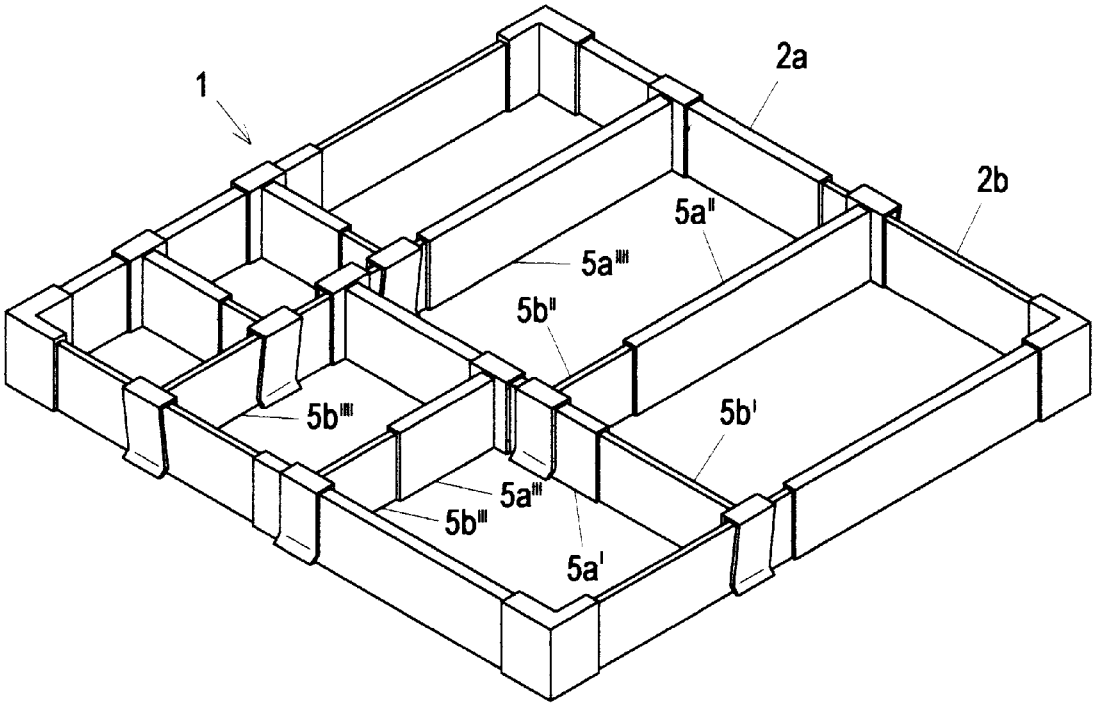
Figure 3A:
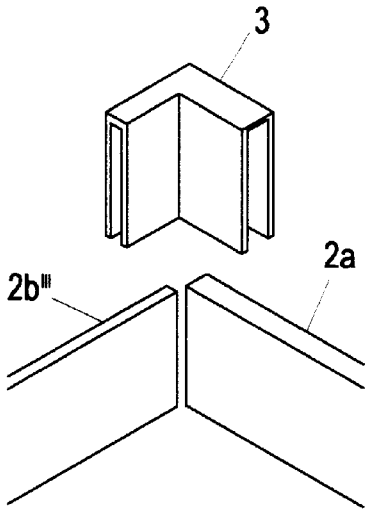
FIGS. 3A–3C are schematic views illustrating assembly of a corner of a perimeter of the organizer assembled according to FIGS. 2A–2C.
Figure 3B:
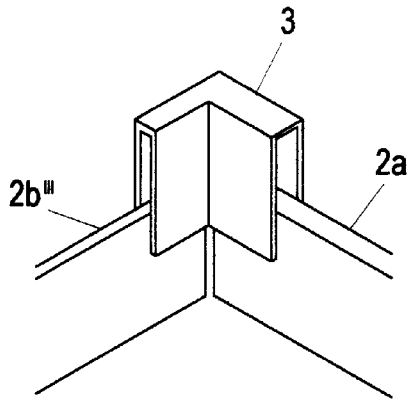
Figure 3C:
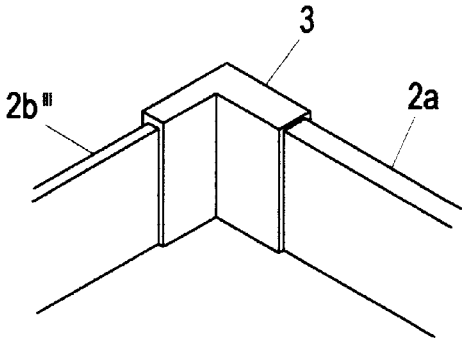
Figure 4A:
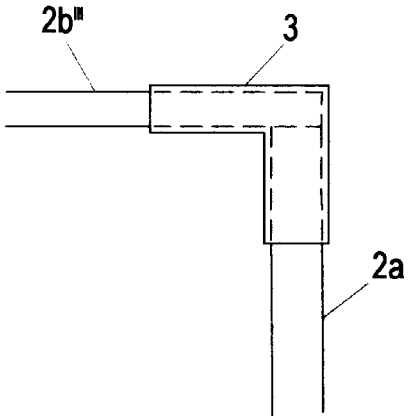
FIGS. 4A–4B are top plan views respectively illustrating different arrangements for assembling the corners of the organizer perimeter.
Figure 4B:
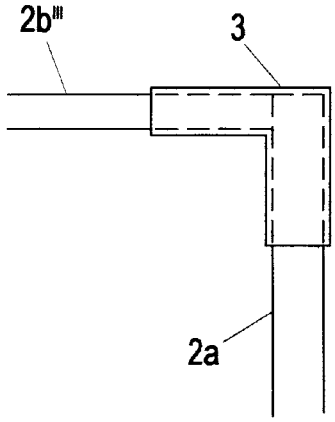
Figure 5A:
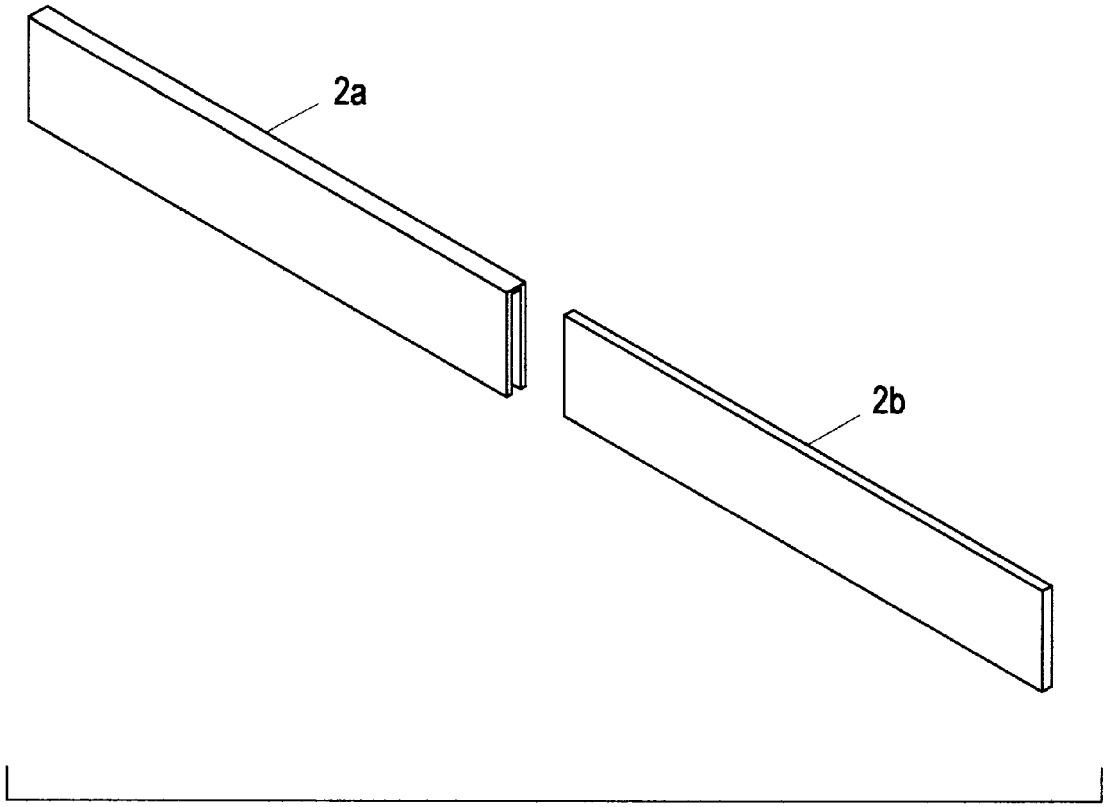
FIGS. 5A–5B are schematic perspective views illustrating assembly of telescoping members forming a panel of the organizer.
Figure 5B:
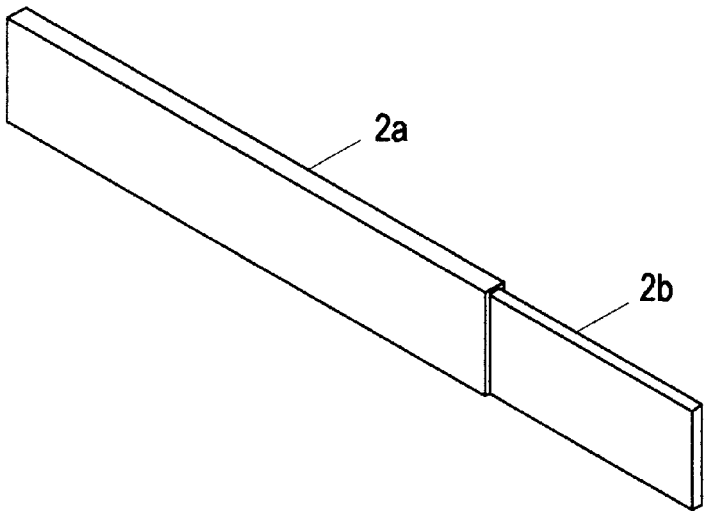
Figure 6A:
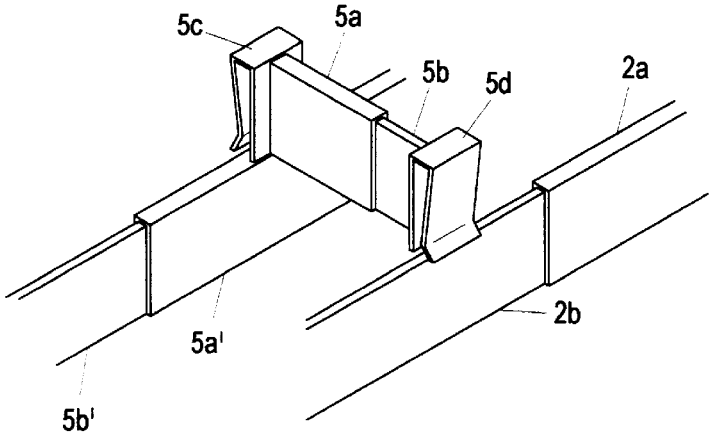
FIGS. 6A–6C are schematic perspective views illustrating assembly of partitions within the organizer.
Figure 6B:
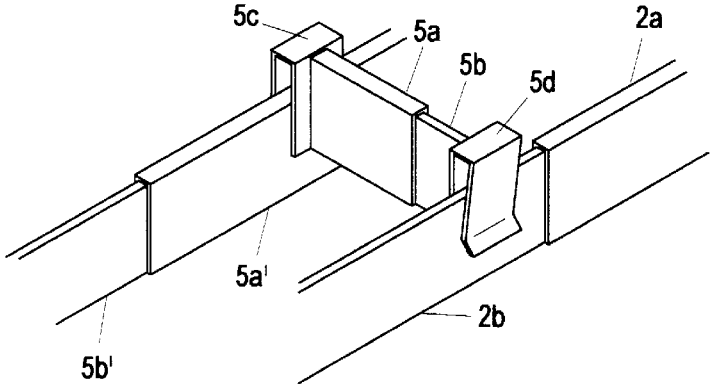
Figure 6C:
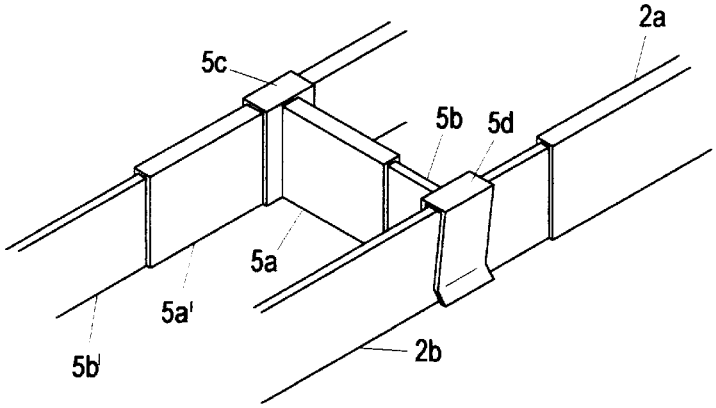

In assembling the inventive organizer, the perimeter panels 2 can first be coupled and clipped together with corner clip elements 3 as shown in FIG. 2B. Then, divider panels 5 can be arranged (FIG. 2A) together and clipped to form an arrangement as shown, e.g., in FIG. 2C. FIGS. 3A–3C illustrate coupling of the corners of the perimeter panels 2 together with clip elements 3, while FIGS. 4A and 4B illustrate possible arrangement of the panel members 1 within the clip elements 3 for securely retaining the panels together. This arrangement is asymmetric as shown in FIGS. 4A and 4B, which enhances stability of the secured organizer, against inadvertent loosening and separation upon accidental jostling. FIGS. 5A and 5B illustrate telescopic coupling of individual perimeter panel members together.

Figure 10A:
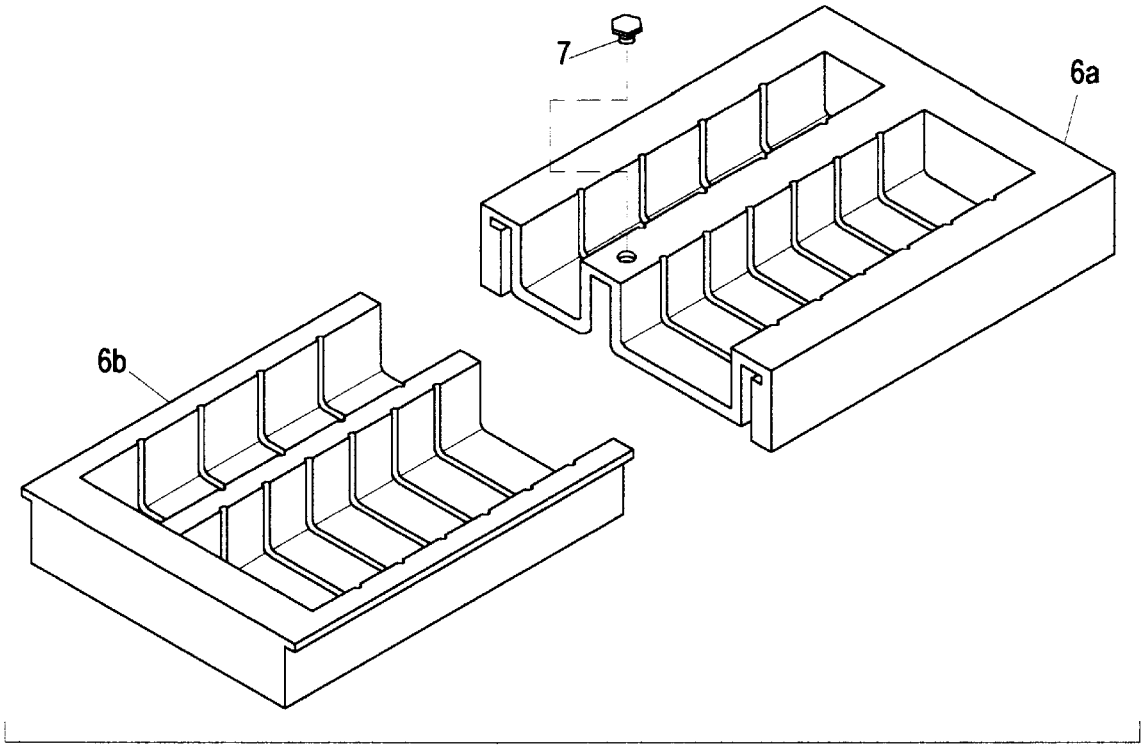
FIGS. 10A–10B are schematic perspective views illustrating assembling of telescoping members forming a tray of the organizer.
Figure 10B:
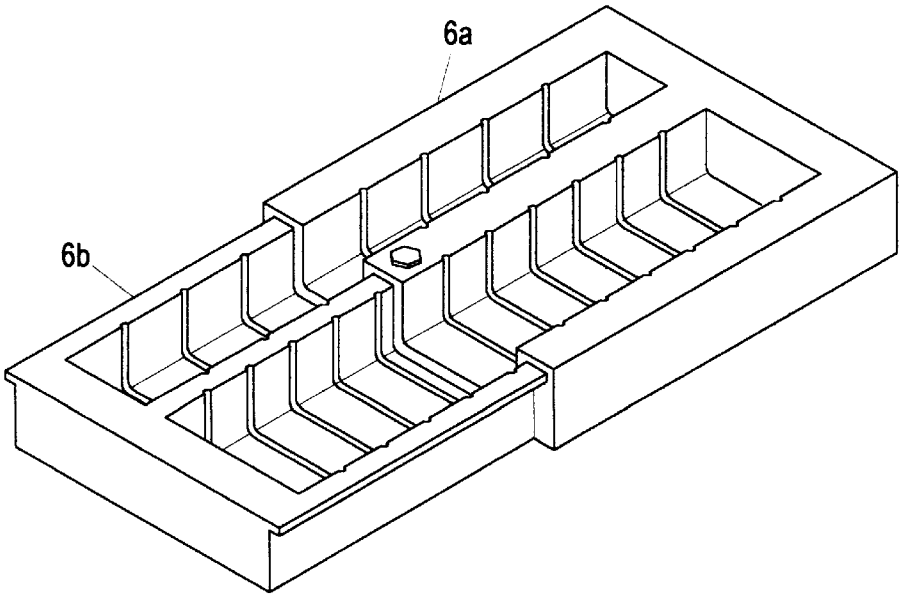
Figure 11A:
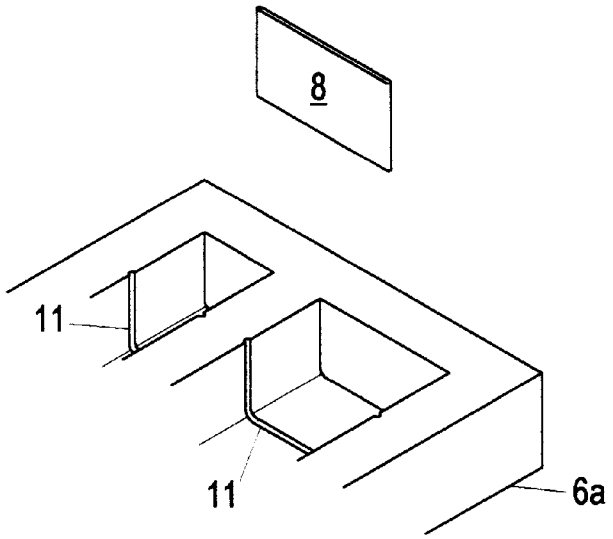
FIGS. 11A–11C are schematic views illustrating insertion of a divider into a tray.
Figure 11B:
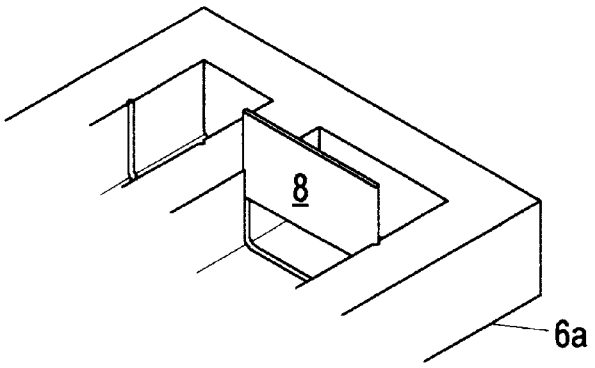
Figure 11C:
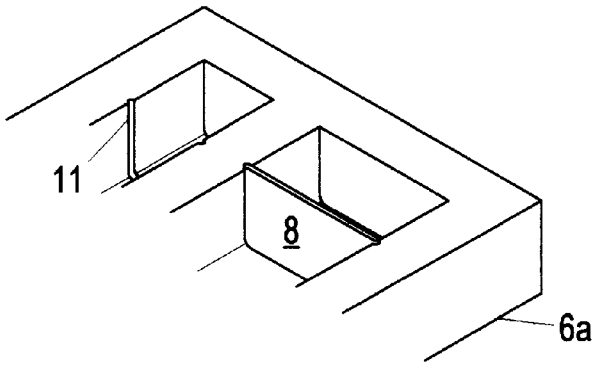
Figure 12:
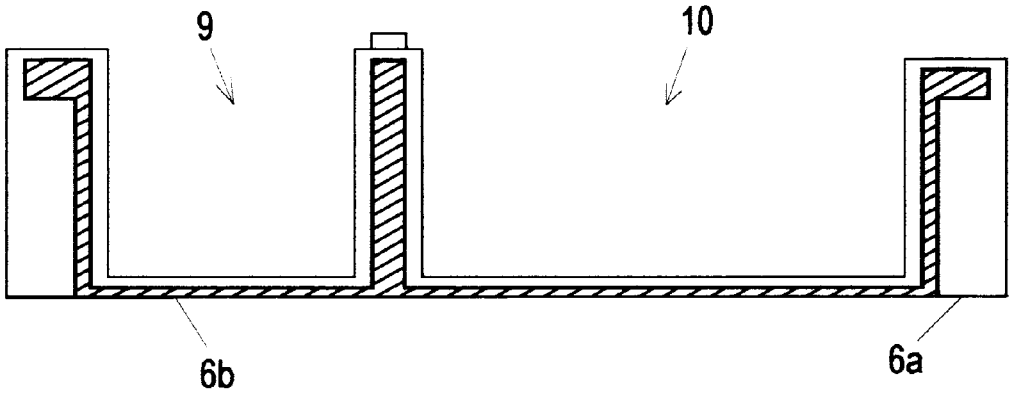
FIG. 12 is a longitudinal end view, partially in section, of the tray illustrated in FIGS. 10A–B and 11A–C.
Figure 13:
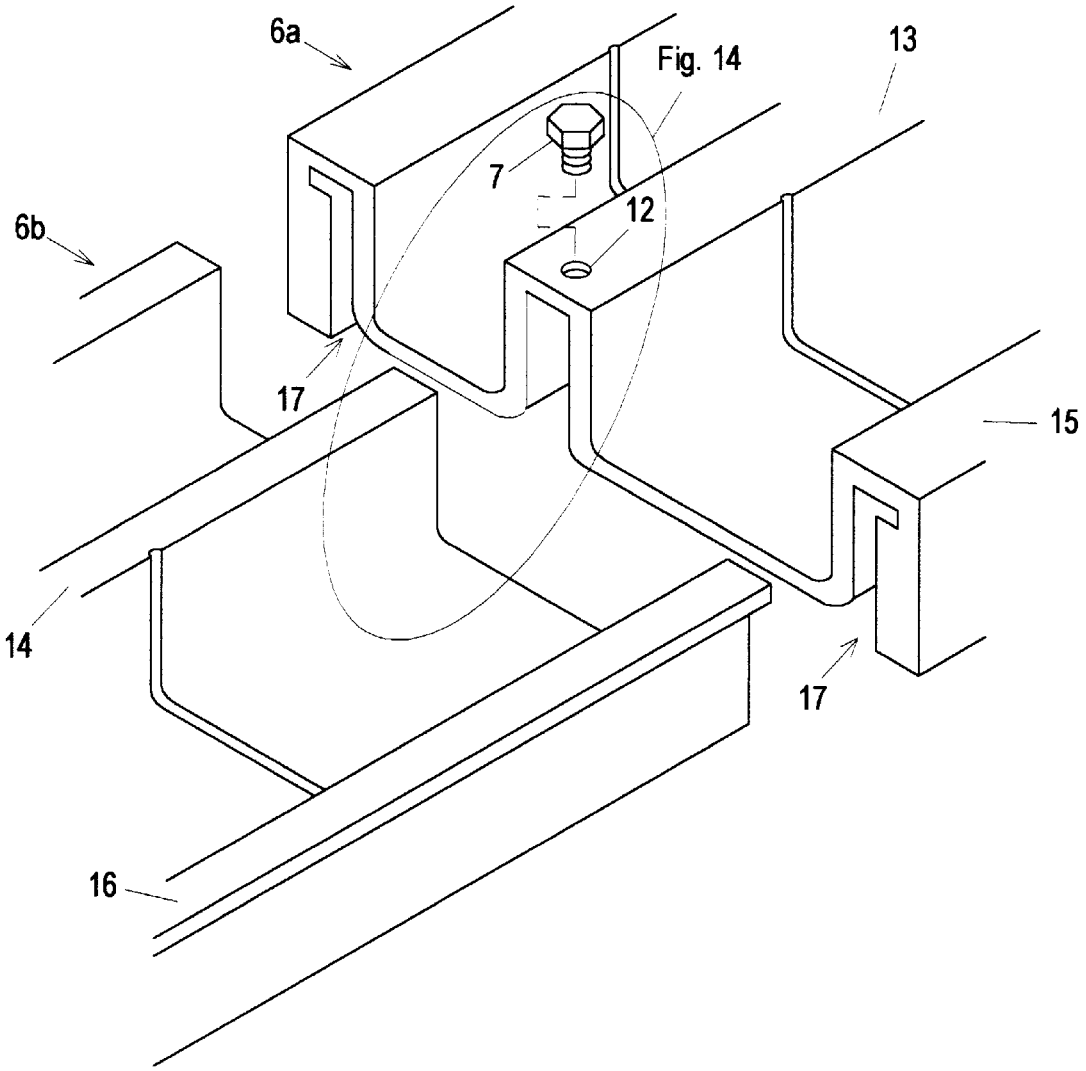
FIG. 13 is a schematic view illustrating, in detail, securing of the telescopic members forming the tray of FIGS. 10A and 10B together.
Figure 14:
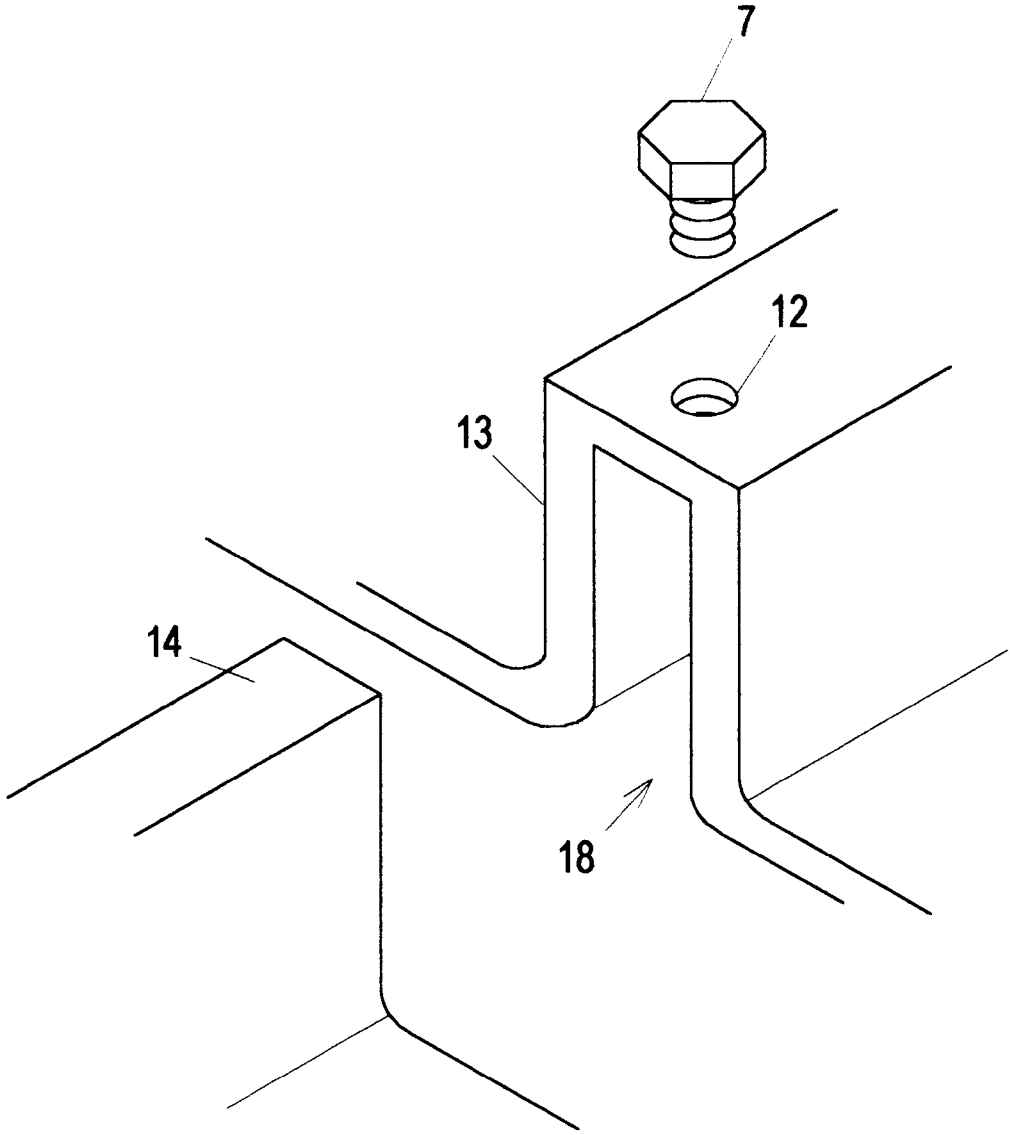
FIG. 14 is an enlarged view of the encircled area in FIG. 13.
Figure 15:
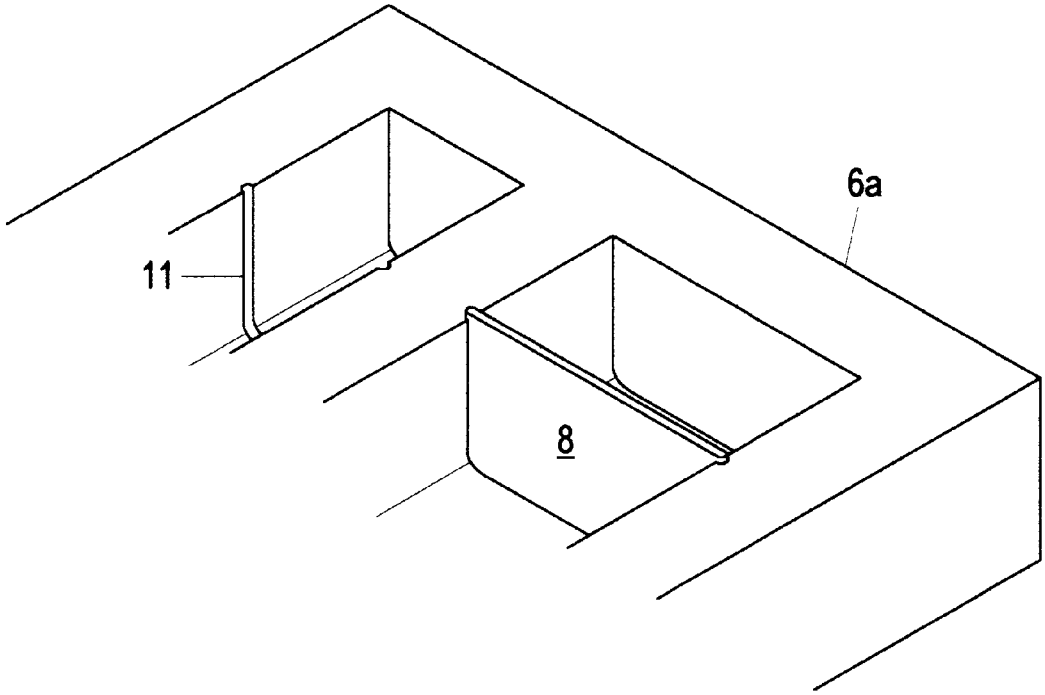
FIG. 15 is an enlarged view, similar to FIG. 11C, illustrating division of a tray into compartments.
Figure 17:
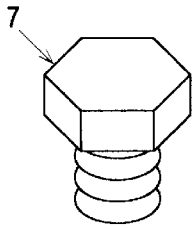
FIG. 17 is an elevational view illustrating means for securing the tray together.
Figure 16:
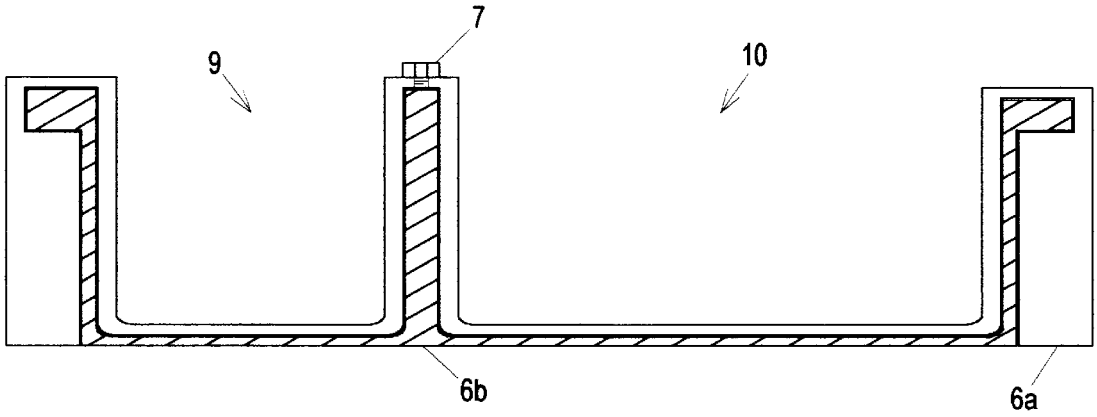
FIG. 16 is a longitudinal end view, partially in section, and similar to FIG. 12, illustrating securing of the telescopic members forming the tray together.
Figure 18A:
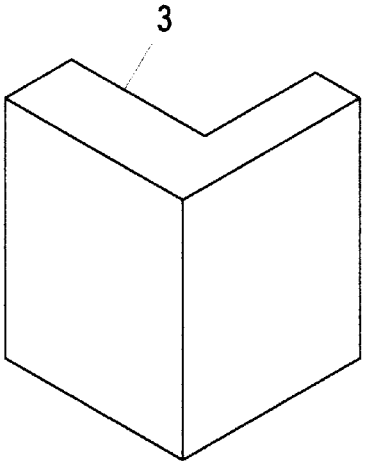
FIGS. 18A–D are various perspective view illustrating means for securing corners of the organizer perimeter together.
Figure 18B:
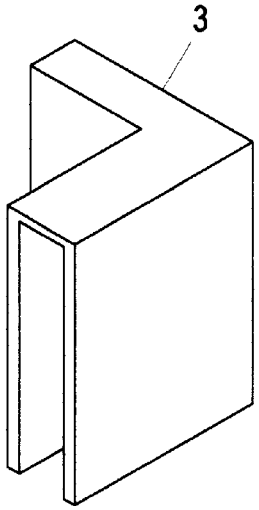
Figure 18C:
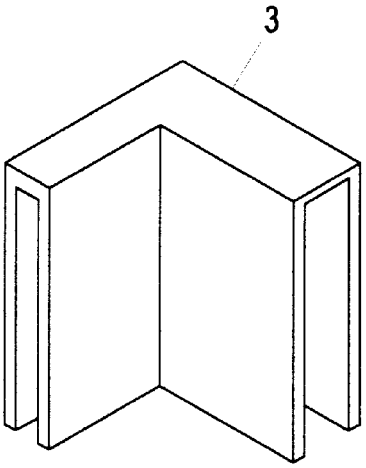
Figure 18D:
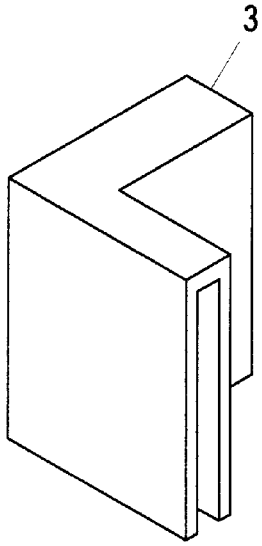

The organizer 1 of the present invention also includes an adjustable tray 6 as illustrated in FIGS. 11–17. More specifically, the tray 6 comprises respective telescopic male and female elements 6*b* and 6*a* which are secured together with coupling means, e.g. a set screw 7 (FIG. 17) as shown in FIGS. 13 and 14. After the telescopic tray member have been adjusted to appropriate length as shown, e.g., in FIG. 10B, then the set screw is simply screwed into threaded bore 12 to retain the tray at a desired length as shown in FIGS. 12 and 16. Each tray can also comprise two respective storage wells 9 and 10 separated by a shoulder or ridge 13 and 14 (FIGS. 13 and 14) of respective female and male tray members 6*a* and 6*b*. The base and sides of each respective well 9 and 10 is further provided with a series of substantially equidistantly spaced indentations 11 designed to receive dagger-like partitions 8 to further partition each well 9 and 10 into a series of compartments. These dagger-like partitions 8 can be securely seated in respective indentations as needed; they can be omitted entirely, should larger, partitioned wells 9 and 10 be required. Additionally, while the inventive tray is shown with two longitudinal wells separated by a ridge 13/14, provision of just a single well in a tray can be provided in accordance with the present invention. The means for securing the telescoping members 6*a* and 6*b* could then be moved, e.g., to an outer ledge 15 of female telescopic member 6*a* (male telescopic member 6*b* is provided with a complementary inner ledge member 16 which is received in complementary groove 17 upon assembly; ridge 14 is received in complementary groove 18 as shown in. FIG. 14).

Figure 19:
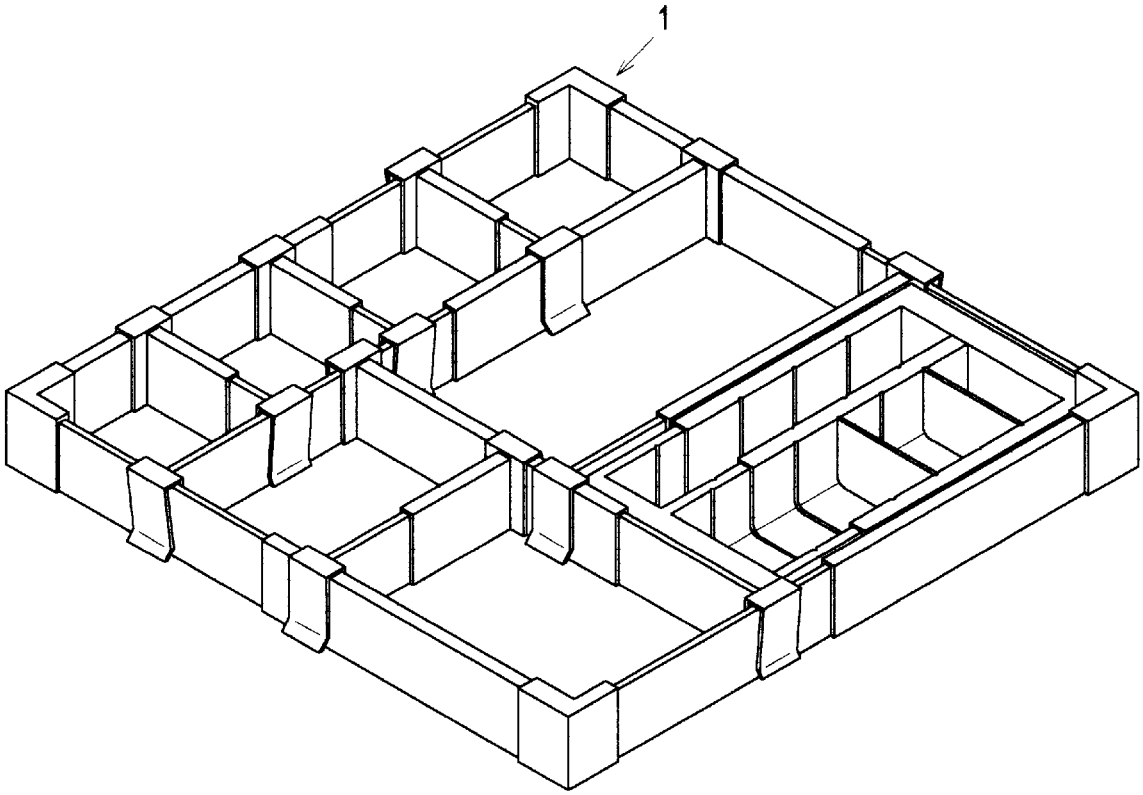
FIG. 19 is a perspective view of the assembled organizer, similar to FIG. 1, and additionally illustrating reception of a tray in one of the interior compartments of the assembled organizer.
Figure 20:
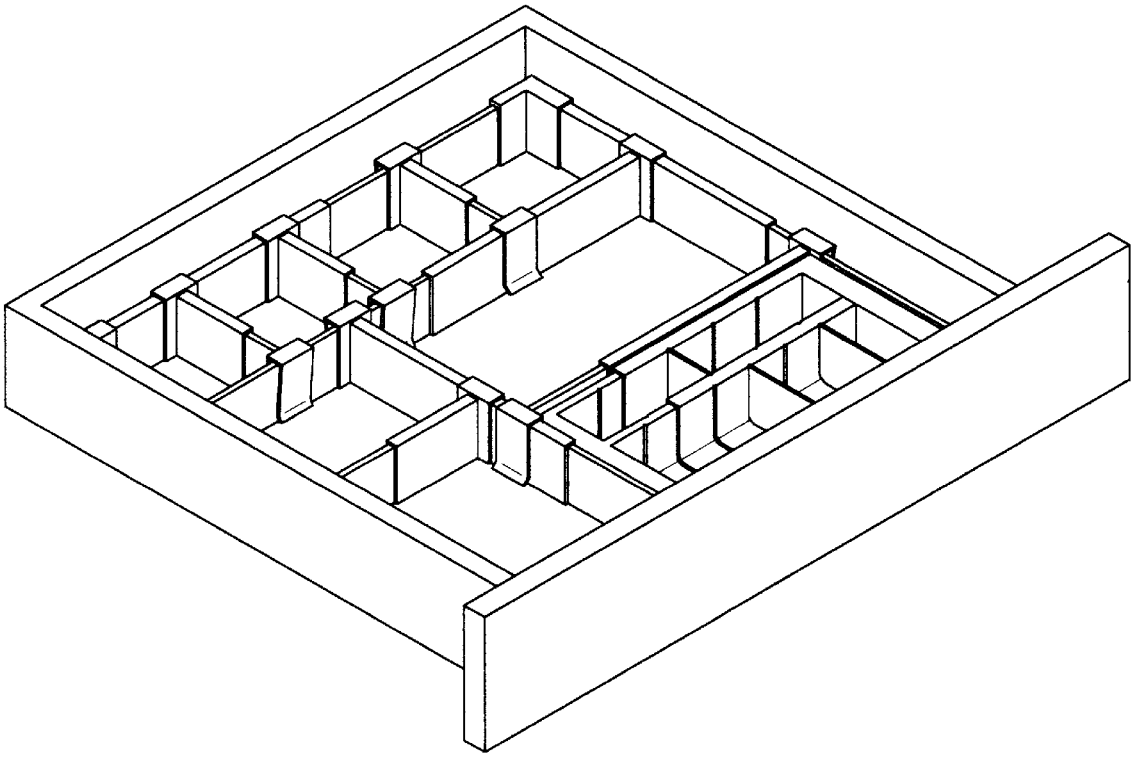
FIG. 20 is a perspective view, similar to FIG. 19, and additionally illustrative of the assembled organizer positioned in a drawer.

The assembled tray 6 can then be securely seated within a compartment of the assembled organizer as shown in FIG. 19. After insertion of the tray 6 therein, position of the various panels 2, 5, etc. around the tray 6 can be adjusted in situ to securely retain the tray 6 within the organizer. Such adjustment is not possible with any of the prior art organizers. The various components forming the inventive organizer, including the tray, can be constructed from metallic material such as stainless steel, wood or paper material such as cardboard or balsa wood, or plastic material such as suitable polyethylenes or polypropylenes. In this regard, the various plastic parts can be appropriately molded to specifications, e.g., by injection molding.

The various components of the inventive organizer can be manufactured in any required size to be accommodated in any outer container such as a desk or bureau drawer. For example, outer perimeter panels 2 can be manufactured to have a length of about 10 inches minimum (when members 2*a* and 2*b* are telescoped together), expandable to a maximum extended length of about 19 inches. By the same token, divider panels 5 can be provided with various expandable lengths. For example, panels 5 can possess a minimum length of about 10 inches expandable to about 19 inches maximum (including outer clips 5*c* and 5*d*); a minimum length of about 6 inches, expandable to about 11 inches maximum; a minimum length of about 4 inches, expandable to about 7 inches; and a minimum length of about 3 inches, expandable to about 5 inches. In a preferred kit, four such divider panels 5 of each length can be provided, together with four outer perimeter panels 2.

Additionally, the clip elements 3 can be formed with complementary recesses to receive either male 2*b* and/or female 2*a* panel members. While FIGS. 3*a–c* and 4*a–b* illustrate a clip element 3 formed to receive adjacent male and female perimeter panel members, it is within the contemplation of the present invention to provide clip elements 3 formed to receive two male perimeter panel members in adjacent recesses, or two adjacent female perimeter panel members in the adjacent recesses, or male and female perimeter panels in opposite arrangement to that shown in FIGS. 3*a–c* and 4*a–b*.

Furthermore, the outer perimeter panels can each be approximately 1½–2 inches in height and about ⅛ and ½ inch in width. Labeling means can also be affixed to each divider panel to indicate the articles retained in each compartment.

Accordingly, it is quite clear that the organizer of the present invention provides the advantages described above including those which become apparent from the present description. In this regard, the description of the present invention is merely exemplary, and not intended to limit the scope thereof in any way.

What is claimed is:

1. An organizer for forming a plurality of compartments, said organizer comprising:

perimeter panels formed to define an outer perimeter of said organizer and two or more compartments within said perimeter formed by dividing panels, said perimeter and dividing panels arranged to be adjustable in length, and first clip elements arranged to secure adjacent perimeter panels for forming said perimeter together and second clip elements to retain dividing panels to adjacent perimeter panels or dividing panels forming said plurality of compartments, wherein said perimeter and dividing panels each comprise at least two telescopically-arranged members including an inner male telescopic member and an outer female telescopic member having an open bottom portion, with the inner dimensions of said outer female telescopic member and outer dimensions of said inner telescopic member being substantially complementary, such that said respective members can be extended to from or retracted into one another, with said panels having an adjustable length, and said second clip elements being formed in one-piece unitary construction upon the respective ends of the dividing panels, said second clip elements having two downwardly depending legs, one leg on each side of the dividing panel or perimeter panel over which the element is placed, the legs having a vertical height, said height being substantially the same as the dividing panels and perimeter panels, said second clip elements having an open bottom portion, are arranged to clip onto perimeter panels or dividing panels, said second clip elements are arranged to have an inwardly bent portion defining a minimal interior width that is smaller than a width of a respective panel member to which said clip is being applied, such that said respective clip element can be spread outwardly by insertion upon the respective panel from above and not be permanently deformed by such insertion so that said respective clip element will return to shape upon removal from the respective panel to which said clip element is applied, said second clip elements being of limited horizontal extent being substantially smaller than a length of the perimeter or dividing panel over which the element is placed, said second clip elements for securing said device are also arranged to slide along oppositely-arranged panels so that position of respective dividing panels can be adjusted to form interior compartments, whereby said panels on which said clips elements are formed are secured in position and fixed at a set length.

2. The organizer of claim 1, additionally comprising:

trays arranged to seat in said compartments formed by said organizer.

3. The organizer of claim 2, additionally comprising means for fixing each said tray in position at a set length and comprising:

a threaded bore in an outer telescopic member of adjacent telescopic members, and a threaded bolt or screw arranged to be screwed into said bore and contact an inner telescopic member of the adjacent telescopic members, whereby said adjacent telescopic members are secured in position.

4. The organizer of claim 2, wherein said telescopic members each comprise a series of indentations along opposite inner walls and a bottom inner surface thereof, and additionally comprising at least one partition arranged to securely seat in each said indentation and further divide each said adjustable tray into two or more sections.

5. The organizer of claim 2, wherein at least one of said trays comprises two substantially parallel wells running in a lengthwise direction therealong, and a ridge also running in the lengthwise direction therealong and separating said respective wells from one another.

6. The organizer of claim 1 wherein each said well comprises a series of indentations along opposite inner walls and a bottom inner surface thereof, and additionally comprising at least one partition arranged to securely seat in each said indentation and further divide each said well into two or more sections.

7. The organizer of claim 6, wherein said indentations of adjacent wells are staggered in the lengthwise direction with respect to one another.

8. The organizer of claim 1.

9. The organizer of claim 1, wherein said clip elements for securing said perimeter panels are each formed at substantially right angles or acute angles and, with said perimeter panels, being structured and arranged to be coupled in an asymmetric manner, enhancing stability.

10. The organizer of claim 1, wherein said panels defining said compartments within said perimeter also comprises at least two telescopic members, an inner male telescopic member and outer female telescopic member having an open bottom portion with inner dimensions of said outer female telescopic member and outer dimensions of said inner male telescopic member being substantially complementary.

* * * * *